US010107223B2

(12) United States Patent
Walder et al.

(10) Patent No.: US 10,107,223 B2
(45) Date of Patent: Oct. 23, 2018

(54) METHOD FOR DETERMINING AT LEAST ONE INJECTION PARAMETER OF AN INTERNAL COMBUSTION ENGINE, AND INTERNAL COMBUSTION ENGINE

(71) Applicant: MTU Friedrichshafen GmbH, Friedrichshafen (DE)

(72) Inventors: Michael Walder, Ravensburg (DE); Robby Gerbeth, Friedrichshafen (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 138 days.

(21) Appl. No.: 14/904,270

(22) PCT Filed: Aug. 1, 2014

(86) PCT No.: PCT/EP2014/002125

§ 371 (c)(1),
(2) Date: Jan. 11, 2016

(87) PCT Pub. No.: WO2015/022057

PCT Pub. Date: Feb. 19, 2015

(65) Prior Publication Data

US 2016/0153382 A1 Jun. 2, 2016

(30) Foreign Application Priority Data

Aug. 14, 2013 (DE) ..... 10 2013 216 192

(51) Int. Cl.
*F02D 41/26* (2006.01)
*F02D 41/38* (2006.01)
(Continued)

(52) U.S. Cl.
CPC ..... *F02D 41/263* (2013.01); *F02D 41/3809* (2013.01); *F02D 41/221* (2013.01);
(Continued)

(58) Field of Classification Search
CPC ..... F02D 1/02; F02D 33/00; F02D 33/006; F02D 41/40; F02D 41/22; F02D 41/263; F02D 41/2467; F02D 41/3809; F02D 41/3827; F02D 2041/224; F02D 2041/286; F02D 2200/0602; F02D 2200/0614; F02D 2200/0616; F02D 2200/0618; F02D 2250/31; Y02T 10/44
(Continued)

(56) References Cited

U.S. PATENT DOCUMENTS 5,771,861 A * 6/1998 Musser ..... F02D 41/1401 123/357
6,088,647 A 7/2000 Hemberger et al.
(Continued)

FOREIGN PATENT DOCUMENTS

DE 19740608 A1 3/1999
DE 10036154 A1 2/2002
(Continued)

OTHER PUBLICATIONS

Alexander Ilin et al: "Practical Approaches to Principal Component Analysis in the Presence of Missing Values". Journal of Machine Learning Research. Jan. 1, 2010 (Jan. 1, 2010). pp. 1957-2000, XP055149278.

*Primary Examiner* — John Kwon
*Assistant Examiner* — Johnny H Hoang
(74) *Attorney, Agent, or Firm* — Lucas & Mercanti, LLP; Klaus P. Stoffel

(57) ABSTRACT

A method for determining at least one injection parameter of an internal combustion engine, including the following steps: detecting a pressure profile in a time-resolved manner in an injection system of an internal combustion engine at least during an injection; providing a reference pressure profile for at least one operating point of the injection system; comparing the detected pressure profile with the reference pressure profile, and ascertaining at least one injection parameter as a function of the comparison.

18 Claims, 2 Drawing Sheets

(51) Int. Cl.
*F02D 41/22* (2006.01)
*F02D 41/40* (2006.01)
*F02D 41/28* (2006.01)

(52) U.S. Cl.
CPC ..... *F02D 41/40* (2013.01); *F02D 2041/224* (2013.01); *F02D 2041/286* (2013.01); *F02D 2200/0602* (2013.01); *F02D 2200/0614* (2013.01); *F02D 2200/0618* (2013.01); *F02D 2250/31* (2013.01)

(58) Field of Classification Search
USPC ..... 123/295, 299, 445, 447, 456, 457, 460, 123/512; 701/103–105
See application file for complete search history.

(56) References Cited

U.S. PATENT DOCUMENTS 7,523,743 B1 * 4/2009 Geveci ..... F02D 41/3863 123/456
7,835,850 B2 11/2010 Nakata et al.
8,155,859 B2 * 4/2012 Nakata ..... F02D 41/2474 701/103
8,214,131 B2 7/2012 Kloos et al.
8,459,234 B2 6/2013 Nakata et al.
2009/0164086 A1 * 6/2009 Geveci ..... F02D 41/2438 701/102
2009/0164095 A1 * 6/2009 Geveci ..... F02D 41/0087 701/103
2010/0030450 A1 * 2/2010 Doelker ..... F02D 41/3809 701/103
2013/0311063 A1 * 11/2013 Ito ..... F02D 41/1497 701/103

FOREIGN PATENT DOCUMENTS

DE 102004031007 A1 2/2005
DE 102004031006 A1 4/2005
DE 10356858 B3 7/2005
DE 102006034514 A1 1/2008
DE 102007009565 A1 8/2008
EP 1884646 A2 2/2008
EP 1990528 A2 11/2008
EP 2031226 A2 3/2009

* cited by examiner

METHOD FOR DETERMINING AT LEAST ONE INJECTION PARAMETER OF AN INTERNAL COMBUSTION ENGINE, AND INTERNAL COMBUSTION ENGINE

The present application is a 371 of International application PCT/EP2014/002125, filed Aug. 1, 2014, which claims priority of DE 10 2013 216 192.1, filed Aug. 14, 2013, the priority of these applications is hereby claimed and these applications are incorporated herein by reference.

BACKGROUND OF THE INVENTION

The invention relates to a method for determining at least one injection parameter of an internal combustion engine and to an internal combustion engine.

Methods and internal combustion engines of the type addressed here are known. German patent DE 103 56 858 B4 discloses a method in which a time profile of an electrical operating variable of an actuator is measured during the injection operation. The measured profile of the electrical operating variable is compared with a stored reference curve, wherein the reference curve represents the time profile of the operating variable in a reference pattern. An injection parameter, in particular a start of injection, is ascertained as a function of the comparison. It is disadvantageous here that the electrical operating variable or its time profile is linked only indirectly to the injection variables, such as, for example, the start of injection and the injected fuel quantity, which are relevant for the operation of the internal combustion engine. Therefore, for example the actual physical start of the injection of fuel into a cylinder of the internal combustion engine deviates frequently from the start of energization of the injector. In particular, the comparison of the measured profile of the electrical operating variable with the stored reference curve requires a comparatively costly and complex procedure in order to ascertain plausible values for the injection parameter.

It is also known to ascertain injection parameters of an internal combustion engine by evaluating pressure profiles in an injection system which have been detected in a time-resolved manner. In this context, there is a direct relationship between the pressure profile and the injection parameters. However, the problem arises here that a measured pressure profile typically has a frequency mixture which comprises, in particular, the delivery frequency of a high pressure pump of the injection system as well as frequencies which result from reactions of the various injectors. It is therefore not readily possible to determine injection parameters such as the start of injection and the injected fuel quantity from the detected pressure profile. The detected pressure profile is typically filtered, which gives rise to a phase offset and to a loss of information, and there is therefore a need to improve the accuracy of such methods.

SUMMARY OF THE INVENTION

The invention is based on the object of providing a method and an internal combustion engine which do not have the specified disadvantages. In particular, with the method and the internal combustion engine it is to be possible to determine at least one injection parameter quickly, cost-effectively and very accurately, at low cost.

The object is achieved by providing a method in which the pressure profile is detected in a time-resolved manner in an injection system of an internal combustion engine at least during an injection. A reference pressure profile for at least one operating point of the injection system is provided. The detected pressure profile is compared with the reference pressure profile, and at least one injection parameter is ascertained as a function of the comparison. By virtue of the fact that the injection parameter is ascertained on the basis of a pressure profile in the injection system, the injection parameter is determined by means of a physical variable which is directly linked to said parameter, and for this reason a high level of accuracy is already possible. Since the detected pressure profile is compared with the reference pressure profile in order to ascertain the injection parameter, there is no need for any filtering, avoiding a phase shift and loss of information. The comparison is quick and can be carried out in real time, and the method is at the same time low in cost. It is robust if a complete injection cycle is considered, and the injection parameter is therefore not ascertained on the basis of the evaluation of only a few selected measuring points, for example consideration of a minimum or a maximum value of the pressure profile. At the same time, the requirements which are made of the injection system are low. In particular, there is no need for a fixed relationship between a delivery frequency of the high pressure pump and an injection frequency of the injectors. Frequencies which are in principle disruptive do not have any adverse effect on the method, since they do not have any effect on the result owing to the comparison of the detected pressure profile with the reference pressure profile.

It is possible for the pressure profile to be detected continuously during the operation of the internal combustion engine. In this case, a region of the detected pressure profile during an injection is preferably selected for the comparison with the reference pressure profile, in order to reduce the quantity of data which is to be compared. Alternatively, it is possible for the pressure profile to be detected in a time-resolved manner only during an injection. In this context, an at least short interval is preferably also detected before the start of the injection and/or an at least short interval is preferably also detected after the injection, in order to ensure that the start of injection and/or the end of injection are/is reproduced by the pressure profile. The intervals are preferably short here in comparison with a time interval between two injection events of the same injector. The necessary timing is preferably provided by means of a control unit of the internal combustion engine.

The reference pressure profile is acquired in one preferred embodiment of the method by means of test bench measurements of the internal combustion engine, and preferably stored in a control unit. Alternatively it is possible for the reference pressure profile for the specific internal combustion engine or the specific design of internal combustion engine to be calculated or simulated analytically or numerically. This is also preferably not carried out in real time but rather initially before the internal combustion engine is put into operation, wherein the reference pressure profile is stored in the control unit.

In one preferred embodiment of the method, the at least one ascertained injection parameter is used to regulate the injection, in particular to regulate the start of injection and/or the injected quantity of fuel, which is also referred to as the injection quantity. In this context, corresponding setpoint injection parameters are preferably stored in a characteristic diagram in the control unit as a function of the operating points and are compared with the ascertained injection parameter in order to carry out the regulating process. In this context, the ascertained injection parameter is adjusted to the corresponding setpoint injection parameter. Corresponding regulating methods are known, and more details will therefore not be given on them here.

Alternatively or additionally there is provision that the ascertained injection parameter is used to diagnose the injection system. In particular, within the scope of the method, what is referred to as an on-board diagnosis of the injection system is preferably carried out, wherein said injection system is checked for faults in the injection behavior in real time. In this context, troubleshooting is particularly preferably carried out for individual injectors of the internal combustion engine, wherein faulty injectors can be identified.

In a further preferred embodiment of the method, a statement about the quality of the pressure measurement and/or the detected pressure profile is acquired on the basis of the comparison of the detected pressure profile with the reference pressure profile. By means of the comparison with the reference pressure profile, it is accordingly possible both to carry out a diagnosis of the injection system and to qualify the pressure sensor which is provided for detecting the pressure profile. It is therefore also possible, within the scope of the method, to detect and evaluate faults in the pressure measurement and, in particular, in a pressure sensor provided for this purpose.

A method is preferred which is defined by the fact that the reference pressure profile is provided as a function of a setpoint injection quantity as an operating point of the injection system. The reference pressure profile is therefore assigned to a predetermined injection quantity, in particular a volume to be injected or a mass to be injected, with the result that in principle an actual injection quantity can be ascertained by means of comparison of the detected pressure profile with the reference pressure profile. The reference pressure profile is preferably additionally provided as a function of a pressure in a common high pressure accumulator of the injection system, wherein this pressure is preferably a start-of-injection pressure, consequently a pressure which is present in the common high pressure accumulator at the time of a start of injection. Such a common high pressure accumulator is also referred to as a common rail, wherein injection systems which have such a common high pressure accumulator can be referred to as common rail injection systems. The common high pressure accumulator serves to supply a multiplicity of injectors with fuel, wherein it serves at the same time for decoupling the storage pressure from the pressure fluctuations in the region of the individual injectors during the various injections. As a result, quantity metering of an individual injector can be carried out largely independently of the behavior of the other injectors. It is clear that the fuel quantity which is actually injected, consequently the injection quantity, depends on the pressure in the common high pressure accumulator at the start of injection. It is therefore appropriate, in particular in order to ascertain accurately the injection quantity which is actually injected, that the reference pressure profile is provided for an operating point as a function both of the setpoint injection quantity and of the pressure in the common high pressure accumulator, in particular of the start-of-injection pressure. In this context, the operating point of the injection system is given by the setpoint injection quantity and the start-of-injection pressure.

An embodiment of the method is also preferred in which a start of injection is ascertained as an injection parameter as a function of the comparison. Alternatively or additionally, an injection quantity is preferably ascertained as an injected fuel volume or as an injected fuel mass as a function of the comparison. It is possible that alternatively or additionally further injection parameters are ascertained on the basis of the comparison. For example, it is also possible to acquire, within the scope of the method, an end of injection as an injection parameter, and likewise an injection duration can be ascertained.

An embodiment of the method is preferred in which in each case one reference pressure profile is provided for a multiplicity of operating points. The detected pressure profile is compared with more than one reference pressure profile, and a comparison value is optimized. The reference pressure profiles are preferably stored as a function of the setpoint injection quantity and the pressure in the common high pressure accumulator. The detected pressure profile is compared with all the provided reference pressure profiles of with a selection of the stored reference pressure profiles, wherein a variable which specifies a degree of similarity between the detected pressure profile and the respective reference pressure profile is used as a comparison value. The comparison value is optimized by searching for that reference pressure profile which is most similar to the detected pressure profile, at least among the reference pressure profiles used for the comparison. Since each reference pressure profile is assigned a setpoint injection quantity, it is then preferably inferred that the injection quantity which is actually injected within the scope of the detected pressure profile corresponds to the setpoint injection quantity which is assigned to the reference pressure profile which supplies an optimal comparison value with the detected pressure profile. In this way it is possible to ascertain, by repeated comparison of the detected pressure profile with various reference pressure profiles, the injection quantity which is actually injected.

For the start of the comparison, an instantaneous operating point of the internal combustion engine is preferably provided by a control unit and is preferably also used to actuate the injector during the detected injection. An operating point of the injection system corresponds, as it were as a subset, to the operating point of the internal combustion engine which, in addition to the setpoint injection quantity and the pressure in the common high pressure accumulator, typically comprises further parameters, wherein that reference pressure profile which is stored for the operating point which is provided by the control unit is selected as the starting reference pressure profile for the start of the comparison.

All of the reference pressure profiles which are provided or stored preferably have an identical starting injection, wherein the actual starting injection is preferably determined from a time shift of the detected pressure profile relative to the reference pressure profile which is ascertained within the scope of the comparison.

Overall it is possible to ascertain both the start of injection and the actually injected injection quantity within the scope of the method by comparison of the detected pressure profile with the reference pressure profile.

It is possible for the pressure profile to be detected in a time-resolved manner in units of time, preferably in ms. Alternatively it is possible for the pressure profile to be detected in a time-resolved manner in units of an angle of a rotating shaft of the internal combustion engine, in particular in units of an angle of the crankshaft. In this case, it is, however, possible also additionally to take into account the rotational speed of the internal combustion engine or, if appropriate, the rotational speed of the specifically used shaft. The reference pressure profile is preferably provided in the same units as the pressure profile, with the result that there is no need for conversion before the comparison.

Irrespective of which units the pressure profile and/or the reference pressure profile are/is provided in, equidistant points are preferably detected or used and consequently have a constant time interval with respect to one another, making explicit detection or storage for the time axis or angle axis unnecessary, wherein the time values or angle values are instead obtained from an index of the detected points for the pressure profile or the sequence thereof. This gives rise to a considerable reduction in data.

The method is preferably carried out for each injector of an internal combustion engine with a multiplicity of injectors. In this context, within the scope of the method it is readily possible to evaluate the injection parameters on an injector-specific basis and to use them for an injector-specific regulating process of the injection and/or an injector-specific diagnosis of the injection system.

A method is preferred in which the pressure profile is detected in an individual accumulator of an injector of the internal combustion engine. In this context, the injection system of the internal combustion engine has injectors which comprise individual accumulators for a specific fuel volume, from which individual accumulators the injected fuel is extracted during an injection. This gives rise to particularly efficient decoupling of the injectors from one another compared to an injection system without individual accumulators in the individual injectors, and injection events of other injectors therefore only have a small effect, or even no effect at all, on the individual accumulator pressure of an injector under consideration. As a result, the corresponding method has a particularly high level of accuracy because the individual injectors are decoupled from one another by means of the separate storage volumes. Therefore, within the scope of the method, individual determination of the at least one injection parameter is readily possible for each injector.

Alternatively, an embodiment of the method is preferred in which the pressure profile is detected in a fuel line leading to the injector. Here, the measurement point for the pressure profile is preferably positioned as close as possible to the injector. In this way, injector-specific determination of the at least one injection parameter is also possible. The accuracy of this embodiment of the method can be improved by virtue of the fact that the pressure profile is detected downstream of a restrictor which separates the injector from the common high pressure accumulator. The restrictor is arranged in the fuel line in order to decouple the injector hydraulically from the common high pressure accumulator, with the result that pressure fluctuations in the injector during the injection have no effect, or only have a small effect on the pressure in the common high pressure accumulator. Conversely, pressure fluctuations in the common high pressure accumulator which are caused, for example, by injection events in other injectors are communicated only to a small extent or not at all to the line section downstream of the restrictor. At any rate, the restrictor brings about damping of pressure fluctuations in both directions. Therefore, by detecting the pressure profile downstream of the restrictor is it possible to determine the at least one injection parameter with particularly high accuracy on an injector-specific basis.

Alternatively, a method is preferred in which the pressure profile is detected in a common high pressure accumulator of the injection system. In this case, the method is particularly cost-effective because a pressure sensor is provided in the region of the common high pressure accumulator in any case, wherein the signals thereof are merely evaluated in a suitable way within the scope of the method. There is therefore no need for any additional sensors. In this context it is also possible to perform injector-specific determination of the at least one injector parameter because the pressure variations in the common high pressure accumulator can be assigned, on the basis of their chronological position, to the injection events of the individual injectors. In this context, such assignment can be performed readily by the control unit, which actuates the individual injectors at times which are respectively assigned to them. In this context, a known ignition sequence of the internal combustion engine can also be used for the evaluation. However, it is apparent that in this embodiment of the method lower accuracy is obtained than with the embodiments described above. A cylinder-specific or injector-specific regulating process of the internal combustion engine is typically not possible on the basis of this embodiment because the accuracy is not sufficient for this. However, the accuracy is high enough to be able to carry out troubleshooting, in particular in the sense of on-board diagnosis for the injection system. In this context, specifically the accuracy requirements are less than for regulation of the injection. In this context, the method implements the advantage that not only an injection parameter, such as, for example, the injection quantity or the start of injection, can be determined but that also the start of injection, the injection quantity and, in particular, also an end of injection and/or an injection duration can be readily ascertained on the basis of the comparison of the detected pressure profile with the reference pressure profile. Therefore, within the scope of the method it is not only possible to satisfy existing requirements of a system for on-board diagnosis of the injection but, under certain circumstances, it is also possible to satisfy requirements which will be made of such a system in the future. The method is consequently future-enabled.

An embodiment of the method is preferred in which the comparison is carried out by calculating a cross-correlation function of the detected pressure profile with the at least one reference pressure profile. In this case, the cross-correlation function K(T) is given, without restriction of the general validity, for two time-dependent functions x(t), y(t), by the following equation:

$$K(\tau)=\int_{-\infty}^{\infty}x(t)y(t+\tau)dt.$$

For discrete signals $x_i$, $y_i$ at discrete times $t_0$, $t_0+i\Delta t$, . . . , $t_0+N\Delta t$, for i=1, . . . , N, the cross-correlation function corr(k) is given by:

$$\mathrm{corr}(k)=\frac{\sum_{i=1}^{N}x[i]y[i+k]}{\sqrt{\sum_{i=1}^{N}(x[i])^2\sum_{i=1}^{N}(y[i+k])^2}}. \tag{2}$$

On the basis of the cross-correlation function it is possible to ascertain both the similarity and the shift between two signals, curves or data records, here, in particular, between the detected pressure profile and the reference pressure profile. In one preferred embodiment of the method, a start of injection is ascertained as an injection parameter from a shift of the detected pressure profile relative to the reference pressure profile. The cross-correlation function can, as a degree of similarity and as a measure for the shift between the detected pressure profile and the reference pressure profile, be calculated easily and quickly.

A method is also preferred which is defined by the fact that a correlation coefficient of the detected pressure profile with the reference pressure profile is calculated as a comparison value. Here, the correlation coefficient is a measure of the similarity of the pressure profiles which are compared with one another. Said coefficient is at a maximum if the pressure profiles are similar to a maximum degree. It is also possible to use, as a comparison value, a maximum of the cross-correlation function or an integral over the cross-correlation function, consequently a surface area under the cross-correlation function. The comparison value, in particular the correlation coefficient, is maximized by comparing the detected pressure profile with more than one reference pressure profile. Here, that reference pressure profile which yields a maximum correlation coefficient in the case of correlation with the detected pressure profile is searched for. The injection quantity is defined as the setpoint injection quantity which is assigned to the reference pressure profile with a maximum correlation coefficient. Ultimately, that reference pressure profile which is most similar to the detected pressure profile is therefore searched for, wherein it is assumed that the injection quantity which is actually injected corresponds to the setpoint injection quantity for which this reference pressure profile is stored.

Within the scope of the optimization of the comparison value or of the maximization of the correlation coefficient, the process is, as already stated, preferably started with a reference pressure profile which is determined by an operating point which is predefined by the control unit. In one embodiment of the method it is then possible to search the surroundings of this operating point for a local maximum of the correlation coefficient. In this context, basically any searching method can be used, wherein the searching method is preferably supported on the formation of gradients. For example, a searching algorithm in the manner of what is referred to as hill climbing can be applied. In another embodiment of the method, it is also possible that, in particular, statistical searching methods are used to search for a global maximum of the correlation coefficient over the entirety of the reference pressure profiles. As a result, it is possible, under certain circumstances, to increase the accuracy of the method further. In general it is, however, sufficient to search for a local maximum in the surroundings of the initially predefined operating point, because the actually present operating point should not deviate too much from the operating point which is predefined by the control unit, at least if the injection system does not have a fault. Conversely it is possible to detect a fault in the injection system if it is not possible to find a suitable local maximum in the predetermined surroundings around the initial operating point.

A method is also preferred which is defined by the fact that the at least one reference pressure profile is provided as a compressed data set. This makes it possible to reduce the stored quantity of data considerably, which ultimately contributes for the first time to the applicability of the method in an internal combustion engine or in a control unit of the internal combustion engine. The storage resources which are available for this are in fact limited. The compressed data set is preferably expanded before the comparison in order to obtain the respective reference pressure profile.

In this context, a method is preferred which is defined by the fact that the compressed data set is calculated by a main component analysis on the basis of the reference pressure profile, wherein the compressed data set is expanded by an inverse main component analysis. The main component analysis is a statistical analysis method which serves, in particular, to structure and to simplify extensive data sets.

Specifically, in one embodiment of the method the following procedure is preferably adopted: for each operating point of the injection system a reference pressure profile is formed as a unidimensional column vector, without restricting the general applicability. These column vectors are arranged to form a matrix, wherein the row positions of the matrix correspond to the various operating points. Overall, in this way a matrix is obtained which comprises pressure values which vary over time along their column indices, while the row indices characterize various operating points given a defined time index. This matrix is subjected to a main axis transformation, that is to say transformed into a vector space with a new basis. The basis is selected such that the covariance matrix of the data set is diagonalized, wherein the data of the data set are decorrelated. In this context, a statistical dependence of the individual components of the data set on one another is minimized. At the same time, the sequence of the coordinate axes is changed over in such a way that the first main component, which is typically the first column vector of the transformed matrix, comprises the greatest portion of the total variation in the data set, wherein the second main component, consequently typically the second column vector, comprises the second greatest portion, with this continuing in this way. The essential information of the data set is then in the first main components, wherein the rear main components comprise a significantly smaller portion of the total variation and therefore a significantly smaller information content. It is therefore possible to delete the rear main components without replacement without as a result incurring appreciable loss of information. Depending on the desired accuracy of the method, more or fewer main components can be included in the analysis.

The data which is necessary for the expansion of the compressed data set comprises the mean values, ascertained from the original data set, on the basis of the averaging over the operating points with a defined time index, the corresponding standard deviations, the main components calculated within the scope of the main component analysis and the inverses of the coefficients of the main components.

The method is particularly powerful with very large data sets. As an example, without restricting the general applicability, a data set should be considered which respectively comprises 501 measuring points for the reference pressure profiles for 1000 operating points. The original data set accordingly comprises 501 000 data points. Without restriction of the general applicability, four main components will be sufficient here to carry out the method with sufficient accuracy. The data stored last, consequently the compressed data set, then comprises 501 values for the mean values with averaging over the operating points, 501 values for the standard deviations, 4000 values for the four main components with 1000 operating points and 2004 values for the inverses of the coefficients of the main components with 501 points per reference pressure profile. The number of these data points is therefore added to form a total of 7006 points, which ultimately constitute 1% of the original 501 000 data points. The compression rate increases as the size of the original data set becomes larger.

It therefore becomes apparent that the main component analysis has great potential for the generation of a compressed data set on the basis of the reference pressure profiles, and it makes it possible for the first time to carry out such a method appropriately in a control unit of an internal combustion engine or to store corresponding quantities of data in a control unit of an internal combustion engine. Otherwise, with contemporary control units it would, in fact, simply not be possible to provide the number of reference pressure profiles desired in order to carry out the method with sufficient resolution in a memory area of the control unit.

The main component analysis is preferably initially carried out once for the reduction of the data or the compression of the data set, wherein the compressed data set is stored in the control unit. Before comparison of a reference pressure profile with the detected pressure profile, the data set is expanded in order to provide the reference pressure profile which is desired for the comparison. This can be carried out very quickly and with only little expenditure in the control unit.

The considerable data reduction also has the advantage that costs which are incurred in relation to the provision of memory space for the reference pressure profiles are reduced. The compression of the data set, on the one hand, and the expansion, on the other, are carried out as software solutions in a virtually cost-neutral fashion. Overall, the data is available in a compressed form for a model-based regulating process of the injection and/or a diagnosis of the injection system within the scope of the method.

The object also achieved in that an internal combustion engine that is provided. Said internal combustion engine comprises an injection system which has at least one injector. The internal combustion engine also has a pressure sensor which is designed to detect a pressure profile in a time-resolved manner in the injection system during an injection, and is preferably suitably arranged for this purpose. Furthermore, a control unit is provided which is configured to carry out an embodiment of the method described above. In this context, the advantages which have already been explained in relation to the method are implemented.

It is possible for the control unit to be configured to carry out the method by implementing said method in the hardware structure of the control unit. Alternatively, it is possible to load into the control unit a computer program product which comprises instructions on the basis of which a method is carried out according to one of the embodiments described above when the computer program product runs on the control unit.

In this respect, a computer program product is also preferred which comprises instructions on the basis of which a method according to one of the embodiments described above is carried out when the method runs on a computing device, in particular on a control unit of an internal combustion engine.

A storage medium on which such a computer program product is stored is also preferred. It is possible in this context for the storage medium to be embodied as a control unit for an internal combustion engine.

The control unit which is configured to carry out an embodiment of the method described above is also preferred separately.

It is possible that the control unit is embodied as an engine control unit of the internal combustion engine, which engine control unit controls the latter overall. Alternatively it is possible that a separate control unit is provided to carry out the method. In this context it is, in particular, possible that the separate control unit is assigned to the injection system or is a component of the injection system.

The internal combustion engine is preferably embodied as a reciprocating piston engine and preferably comprises a multiplicity of cylinders, wherein each cylinder is preferably assigned at least one injector. The method is preferably carried out in this case for all the injectors and/or cylinders of the internal combustion engine, with the result that an injector-specific or cylinder-specific regulating process of the injection and/or diagnosis of the injection system is possible.

In one preferred exemplary embodiment, the internal combustion engine serves to drive, in particular, heavy land vehicles or watercraft, for example mine vehicles, trains, wherein the internal combustion engine is used in a locomotive or a power unit, or ships. A use of the internal combustion engine to drive a vehicle which is used for defense, for example a tank, is also possible. An exemplary embodiment of the internal combustion engine is preferably also used in a fixed fashion, for example for the fixed supply of energy in the emergency power mode, continuous load mode or peak load mode, in which case the internal combustion engine preferably drives a generator.

A fixed application of the internal combustion engine is also possible for driving auxiliary assemblies, for example fire extinguishing pumps on drilling rigs. The internal combustion engine is preferably embodied as a diesel engine, as a gasoline engine, as a gas engine for operation with natural gas, biogas, special gas or some other suitable gas. In particular, if the internal combustion engine is embodied as a gas engine, it is suitable for use in a combined heat and power unit for the stationary generation of energy.

An internal combustion engine is preferred which is defined by the fact that the control unit has at least one memory area, wherein at least one reference pressure profile for at least one operating point of the injection system is stored in the memory area. The control unit is operatively connected to the pressure sensor for detecting a pressure profile, wherein it has a comparison means which is configured to carry out a comparison of the detected pressure profile with the at least one reference pressure profile. The control unit also has means for ascertaining at least one injection parameter as a function of the comparison.

An internal combustion engine is also preferred which is defined by the fact that the injection system has a common high pressure accumulator and a multiplicity of injectors, wherein a fuel line which is assigned to the injector leads from the high pressure accumulator to each injector. The injection system is therefore embodied as an injection system with a common rail, or as a common rail injection system. In a particularly preferred exemplary embodiment, the injectors each comprise individual accumulators by means of which pressure variations in the injectors are decoupled from the common high pressure accumulator.

Alternatively or additionally, each fuel line comprises a restrictor which is arranged between the high pressure accumulator and the injector which is assigned to the fuel line. In this context, pressure waves which originate from the injector are reflected at the restrictor, with the result that they cannot be propagated into the common high pressure accumulator. This gives rise to particularly good decoupling of the individual injectors from the high pressure accumulator and from one another. In this context there is preferably provision that all the fuel lines have an identical line length from the restrictor to the injector.

An internal combustion engine is preferred which is defined by the fact that the pressure sensor is arranged in such a way that it detects a pressure in the common high pressure accumulator.

In this context, the pressure sensor is preferably arranged directly on the high pressure accumulator. Alternatively it is preferred that the pressure sensor is arranged in such a way that the pressure can be detected in a fuel line, preferably downstream of the restrictor, by means of the pressure sensor. In this case, the pressure sensor is preferably arranged directly on or in the fuel line.

Alternatively, an exemplary embodiment is preferred in which the pressure sensor is arranged in such a way that a pressure can be detected in an individual accumulator of an injector. In this case, the pressure sensor is preferably arranged directly on the injector in the region of the individual accumulator.

The pressure sensor is preferably embodied as a strain sensor or strain gauge.

An exemplary embodiment of the internal combustion engine is also preferred in which an additional pressure sensor is provided for detecting a pressure in the common high pressure accumulator. This is, in particular, preferably the case if the pressure sensor which is used within the scope of the method is arranged in such a way that it detects a pressure in the fuel line or in an individual accumulator of an injector. The additional pressure sensor is preferably provided directly on the high pressure accumulator. Such a pressure sensor is preferably provided in any case on a common rail injection system in order to monitor the pressure in the high pressure accumulator and/or determine an operating point of the injection system, wherein, in particular, a start-of-injection pressure is detected. The control unit is configured to determine an operating point of the injection system as a function of the pressure in the common high pressure accumulator. In particular, the control unit is configured to determine a start-of-injection pressure, in order to determine the instantaneous operating point of the injection system.

Finally, an internal combustion engine is preferred which is defined by the fact that the control unit is configured to predefine an operating point of the injection system. In this context, the operating point is particularly preferably predefined in a load-dependent fashion. In particular, the control unit defines a setpoint injection quantity and a setpoint start of injection, preferably on a cylinder-specific and injector-specific basis. At the same time, preferably either a pressure which is predefined by the control unit is generated in the high pressure accumulator by means of a high pressure pump and/or the pressure which is present instantaneously in the high pressure accumulator is detected and also used to determine the operating point. The control unit is also configured to select a first reference pressure profile as a function of the predefined operating point. In this context, this first reference pressure profile is, within the scope of comparison, first compared with the detected pressure profile. This is based on the idea that whenever there is fault-free functioning of the injection system and of the internal combustion engine the operating point of the injection system which is actually present should lie in the surroundings of the operating point which is predefined by the control unit.

The control unit is preferably additionally or alternatively configured to actuate the at least one injector as a function of the predefined operating point. The injector is actuated here in such a way that a predetermined quantity of fuel is fed at a predetermined time to the cylinder of the internal combustion engine which is assigned to said injector.

The control unit is preferably configured to regulate at least one injection parameter, in particular to regulate the start of injection and/or the injection quantity, wherein the deviations, relevant for the regulating process, of the actual injection parameters from the setpoint injection parameters are preferably ascertained within the scope of the method.

The description of the method, on the one hand, and the description of the internal combustion engine, on the other, are to be understood as complementary to one another. In particular, features of the internal combustion engine which have been explicitly or implicitly described in relation to the method are preferably, individually or in combination with one another, features of an exemplary embodiment of the internal combustion engine. Conversely, method steps which have been explicitly or implicitly described in relation to the internal combustion engine are preferably, individually or in combination with one another, method steps of an embodiment of the method.

The invention will be explained in more detail below with reference to the drawing, in which:

DETAILED DESCRIPTION OF THE INVENTION

Figure 1:
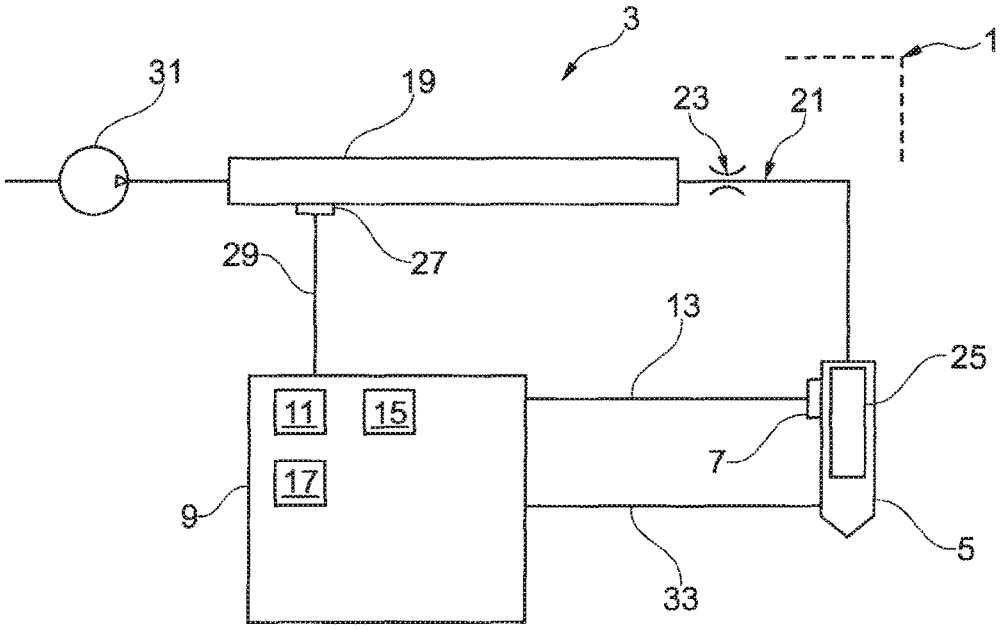
FIG. 1 shows a schematic illustration of an exemplary embodiment of an internal combustion engine.

FIG. 1 shows a schematic illustration of an exemplary embodiment of an internal combustion engine 1. The latter has an injection system 3 which comprises at least one injector 5. The internal combustion engine 1 or the injection system 3 preferably comprises a multiplicity of injectors, and in particular the internal combustion engine 1 is preferably embodied as a reciprocating piston machine with a multiplicity of cylinders, wherein each cylinder is assigned an injector 5. In this respect, by way of example just one injector 5 is illustrated in FIG. 1 merely for the sake of simpler illustration.

However, it is not ruled out that an exemplary embodiment of the internal combustion engine 1 has just one injector 5, in particular just one cylinder, with an injector 5 which is assigned thereto.

A pressure sensor 7 for detecting a pressure profile in a time-resolved manner in the injection system 3 during an injection is provided, which pressure sensor 7 is arranged directly on the injector 5 in the exemplary embodiment illustrated in FIG. 1. The pressure sensor 7 is preferably embodied as a strain gauge.

The internal combustion engine 1 also comprises a control unit 9 which is configured to carry out a method according to one of the previously described embodiments of the method, or of an embodiment of the method which is still to be described below.

The control unit 9 comprises a memory area 11 in which reference pressure profiles are preferably stored for a multiplicity of operating points of the injection system 3, wherein each operating point of the injection system 3 is assigned a reference pressure profile. In particular, the reference pressure profiles are stored as a function of a setpoint injection quantity, preferably a setpoint injection volume, and a start-of-injection pressure, wherein all the reference pressure profiles have a corresponding start of injection. The reference pressure profiles are stored as a compressed data set in the memory area 11, which data set is acquired by means of a main component analysis on the basis of the reference pressure profiles which are preferably measured in test bench trials and/or calculated, in particular, in simulation calculations.

The control unit 9 is operatively connected to the pressure sensor 7 for detecting the pressure profile, which is indicated here schematically by a first operative connection 13. The first operative connection 13 can be established by means of cable or else in a cableless fashion.

The control unit 9 has a comparison means 15, wherein the comparison means 15 is configured to carry out a comparison of the detected pressure profile with at least one subset of the reference pressure profiles, wherein the reference pressure profiles which are used for the comparison lie, for example, in a predetermined area surrounding a starting operating point which is predefined by means of the control unit 9 at the start of the comparison for the selection of the first reference pressure profile to be compared.

The control unit 9 also has means 17 for ascertaining at least one injection parameter as a function of the comparison. In the exemplary embodiment illustrated in FIG. 1, the control unit 9 is designed to ascertain an injection quantity, in particular an injection volume and a start of injection as a function of the comparison, wherein the injection quantity is determined by maximizing a correlation coefficient within the scope of the comparison of the detected pressure profile with a multiplicity of reference pressure profiles as that injection quantity which is assigned as a setpoint injection quantity to that reference pressure profile which has the maximum correlation coefficient with the detected pressure profile, wherein the start of injection is ascertained relative to the constant start of injection of the reference pressure profiles on the basis of the shift of the detected pressure profile relative to the reference pressure profile with the maximum correlation coefficient.

The injection system 3 has a common high pressure accumulator 19 and is in this respect embodied as an injection system 3 with a common rail or as a common rail injection system. In this context, a fuel line 21 leads from the high pressure accumulator 19 to each injector 5 and is assigned to said injector 5, and a restrictor 23 is preferably arranged in said fuel line 21, downstream of the high pressure accumulator 19 and upstream of the injector 5 which is assigned to the fuel line 21. The restrictor 23 serves here to bring about hydraulic decoupling of the injector 5 from the rest of the injection system 3, in particular from the high pressure accumulator 19 and from further injectors 5 (not illustrated in FIG. 1). It is preferably provided here that a length of the fuel line 21 from the restrictor 23 as far as the injector 5 is the same for all injectors 5.

In the exemplary embodiment illustrated in FIG. 1, the injector 5 has an individual accumulator 25. The fuel volume which is to be injected is extracted here directly from the individual accumulator 25 during the injection, which contributes to particularly good hydraulic decoupling of the injector 5 from the rest of the injection system 3, in particular from the high pressure accumulator 19 and from the other injectors 5. The pressure sensor 7 is arranged here on the injector 5 in such a way that it can detect the pressure in the individual accumulator 25.

In one preferred exemplary embodiment of the internal combustion engine 1 which comprises a multiplicity of injectors 5, each injector 5 is assigned a pressure sensor 7 which is operatively connected to the control unit 9, with the result that the method can be carried out on an injector-specific and preferably also cylinder-specific basis. It is then possible to carry out, within the scope of the method, an injector-specific and preferably also cylinder-specific regulating process of the injection by means of the method. In particular, injection parameters can be adjusted to setpoint values, wherein the start of injection and/or the injection quantity are/is preferably adjusted. The setpoint injection parameters are predefined here by the control unit 9 as a function of an operating point of the internal combustion engine 1. The injection parameters which are actually present are ascertained by means of the method on the basis of the comparison of the detected pressure profile with the reference pressure profile.

An additional pressure sensor 27 is provided which, in the illustrated exemplary embodiment, is arranged directly on the high pressure accumulator 19, wherein a pressure in the high pressure accumulator 19 can be detected by means of the pressure sensor 27. The control unit 9 is for this purpose operatively connected to the further pressure sensor 27, which is illustrated schematically here by means of a second operative connection 29, which can be established by means of cable or in a cableless fashion. The control unit 9 is preferably configured to determine an operating point of the injection system 3 as a function of the pressure in the high pressure accumulator 19.

A high pressure pump 31 is provided which delivers fuel from a tank (not illustrated in FIG. 1) into the high pressure accumulator 19 and maintains the pressure in the high pressure accumulator 19 at a predetermined setpoint value, preferably by means of a regulating device which acts in return on the further pressure sensor 27. The pressure sensor 27 serves, alternatively or additionally with respect to the control or regulation of the high pressure in the high pressure accumulator 19, also to detect a start-of-injection pressure which corresponds to the pressure in the high pressure accumulator 19 at the start of an injection. Since no fuel flows from the high pressure accumulator 19 into the individual accumulator 25 or to the injector 5 via the fuel line 21 and the restrictor 23 just before the start of the injection, it can be assumed that the pressure which is detected as a start-of-injection pressure in the high pressure accumulator 19 also corresponds to the pressure in the fuel line 21, in the injector 5 and/or in the individual accumulator 25.

The control unit 9 is preferably configured to predefine an operating point of the injection system 3 and to select a first reference pressure profile as a function of this operating point. Furthermore, the control unit 9 is preferably operatively connected to the injector 5 in order to actuate it, which is illustrated schematically in FIG. 1 by means of a third operative connection 33, which can be established by means of cable or in a cableless fashion.

The control unit 9 predefines a setpoint operating point and actuates the injector 5 via the operative connection 33 in such a way that the injection is carried out with a start of injection which corresponds to the setpoint operating point, and an injection quantity which corresponds to said start of injection. During the injection, the pressure profile is detected in a time-resolved manner by the pressure sensor 7 and transferred to the control unit 9 via the operative connection 13. Said control unit 9 determines, as a function of the setpoint operating point, a first reference pressure profile with which the detected pressure profile is compared. A comparison value is then optimized or a correlation coefficient is maximized, in order to ascertain a reference pressure profile in which the comparison value becomes optimal or the correlation coefficient assumes its maximum value. The comparison is preferably carried out by cross-correlating the detected pressure profile with the respective reference pressure profile. If a reference pressure profile with an optimum comparison value, in particular with a maximum correlation coefficient, has been found, the actual start of injection is ascertained as a time shift of the detected pressure profile relative to the reference pressure profile. The injection quantity is defined as that injection quantity which is assigned to the reference pressure profile with the optimum comparison value, in particular with the optimum correlation coefficient, which has been found.

Figure 2:
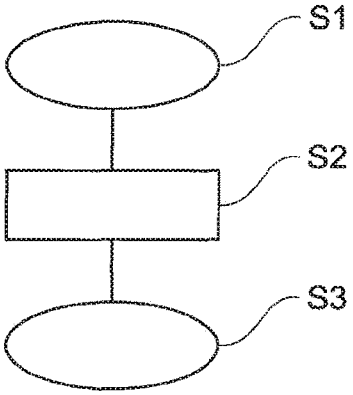
FIG. 2 shows a schematic illustration of the provision of a compressed data set for reference pressure profiles within the scope of an embodiment of the method.

An embodiment of the method will be described in more detail below:

FIG. 2 shows the provision of a multiplicity of reference pressure profiles as a compressed data set in an embodiment of the method in a schematic illustration. In a step S1, reference pressure profiles are provided on the basis of measurements, in particular test bench measurements, and/or on the basis of calculations, in particular simulation calculations, which can be carried out analytically or numerically. Said simulation calculations are subjected, in a step S2, to a main component analysis from which, in a step S3, a compressed data set results which preferably comprises mean values and standard deviations of the original data, in particular averaged over operating points of the injection system 3, the main components resulting from the main component analysis and the inverses of the coefficients of the main components. The compressed data set is stored in the control unit 9, in particular in the memory area 11.

Figure 3:
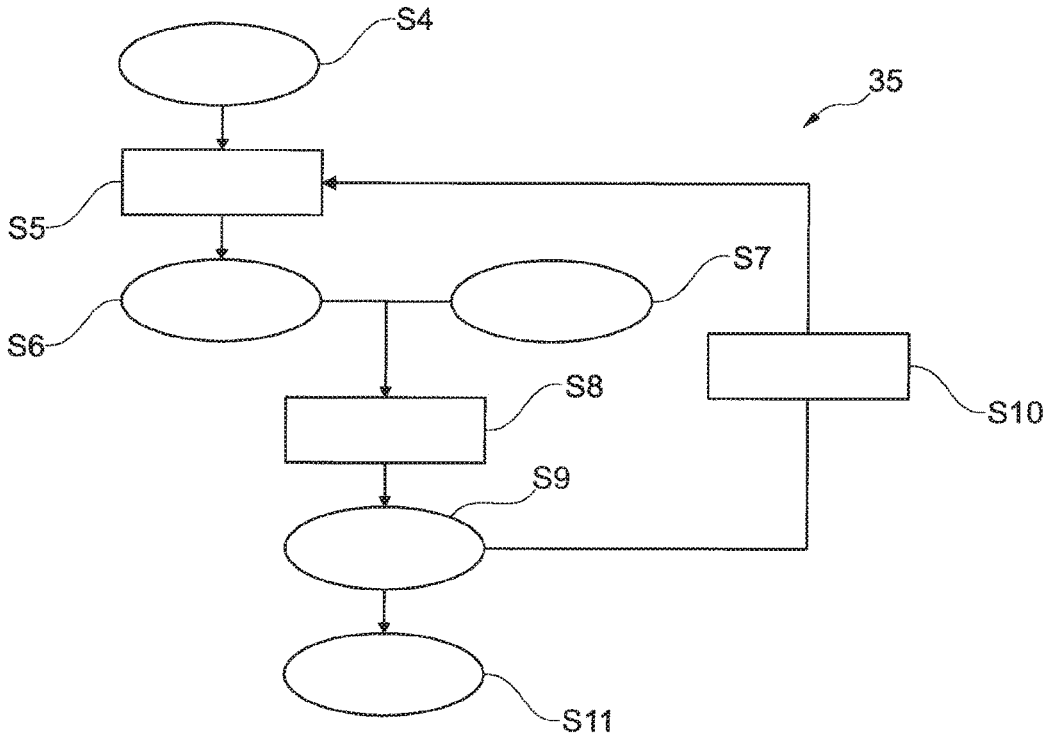
FIG. 3 shows a schematic illustration of the determination of injection parameters within the scope of the embodiment of the method according to FIG. 2.

FIG. 3 shows a schematic illustration of the determination of injection parameters of the internal combustion engine 1 within the scope of the embodiment of the method according to FIG. 2. In a step S4, the compressed data set is read out from the memory area 11, and in a step S5 it is subjected to an inverse main component analysis in order to obtain a reference pressure profile in a step S6. In this context, the control unit 9, which preferably carries out the inverse main component analysis in the step S5, predefines a setpoint operating point for which the correspondingly assigned reference pressure profile is ascertained in the steps S5, S6.

In a step S7, a pressure profile which is detected by the pressure sensor 7 is provided.

In a step S8, the control unit 9 calculates a cross-correlation function between the reference pressure profile provided in the step S6 and the detected pressure profile provided in the step S7, wherein at least one correlation coefficient results from the cross correlation in a step S9.

On the basis of the first reference pressure profile, at least one correlation coefficient is then maximized iteratively in a loop 35 by means of a search algorithm which is illustrated as step S10, wherein within the loop in the step S5 a new reference pressure profile is always provided in the step S6 by means of an inverse main component analysis, which reference pressure profile is compared with the detected pressure profile in step S8, as a result of which at least one new correlation coefficient results in step S9. The loop 35 is run through until a maximum value of the correlation coefficient is found. Once this is the case, in a step S11 at least one injection parameter is ascertained on the basis of the comparison of the detected pressure profile with the reference pressure profile which yields the maximum correlation coefficient. In this context, a start of injection and an injection quantity are, in particular, preferably detected on the basis of the comparison in a way already described.

It is, in particular, possible for deviations of the start of injection and/or of the injection quantity from the setpoint values predefined by the control unit 9 to be determined in the step S11. The injection is then preferably regulated on the basis of these detected deviations.

Alternatively or additionally it is possible to use the at least one injection parameter ascertained in step S11 for an on-board diagnosis of the injection system 3, in order, in particular, to ascertain injector-specific faults of the injection system and to assign them to the faulty injectors.

The search algorithm which is carried out in step S10 is preferably carried out as a local search in a surrounding area of the setpoint operating point which is defined by the control unit 9. In this context, in one preferred embodiment of the method what is referred to as the hill climbing algorithm or some other suitable local search method is used. In another preferred embodiment, a global maximum is performed over all the reference pressure profiles included in the compressed data set, wherein a static search method is preferably applied.

Overall it becomes apparent that the method and the internal combustion engine can be used to determine at least one injection parameter of the internal combustion engine 1 very accurately and in a simple, cost-effective and fast way.

The invention claimed is:

1. A method for determining at least one injection parameter of an internal combustion engine, comprising the steps of:

detecting a pressure profile in a time-resolved manner in an injection system of the internal combustion engine at least during an injection;

providing a reference pressure profile for at least one operating point of the injection system;

comparing the detected pressure profile with the reference pressure profile; and ascertaining at least one injection parameter as a function of the comparison, wherein in each case one reference pressure profile is provided for a plurality of operating points, wherein the detected pressure profile is compared with more than one reference pressure profile, and wherein a comparison value is optimized, and, wherein a correlation coefficient of the detected pressure profile with the reference pressure profile is calculated as a comparison value, wherein the correlation coefficient is maximized by comparing the detected pressure profile with more than one reference pressure profile iteratively in a loop, wherein an injection quantity is defined as the injection quantity which is assigned to the reference pressure profile with a maximum correlation coefficient.

2. The method as claimed in claim 1, wherein the reference pressure profile is provided as a function of a setpoint injection quantity.

3. The method as claimed in claim 2, wherein the reference pressure profile is provided as a function of a pressure in a common high pressure accumulator of the injection system.

4. The method as claimed in claim 3, wherein the reference pressure profile is provided as a function of a start-of-injection pressure.

5. The method as claimed in claim 1, wherein a start of injection and/or an injection quantity is/are ascertained as an injection parameter/injection parameters as a function of the comparison.

6. The method as claimed in claim 1, wherein the pressure profile is detected in an individual accumulator of an injector of the internal combustion engine, in a common high pressure accumulator of the injection system or in a fuel line leading to the injector.

7. The method as claimed in claim 6, wherein the pressure profile is detected downstream of a restrictor that separates the injector from the common high pressure accumulator.

8. The method as claimed in claim 1, wherein the comparison is carried out by calculating a cross-correlation function of the detected pressure profile with the reference pressure profile, wherein a start of injection is ascertained from shifting of the profiles relative to one another.

9. The method as claimed in claim 1, wherein the reference pressure profile is provided as a compressed data set, wherein the compressed data set is expanded before the comparing step.

10. The method as claimed in claim 9, wherein the compressed data set is calculated by a main component analysis based on the reference pressure profile, wherein the compressed data set is expanded by an inverse main component analysis.

11. An internal combustion engine, comprising:

an injection system that includes at least one injector;

a pressure sensor for detecting a pressure profile in a time-resolved manner in the injection system during an injection; and a control unit configured to carry out a method according to claim 1.

12. The internal combustion engine as claimed in claim 11, wherein the control unit has at least one memory area, wherein at least one reference pressure profile for at least one operating point of the injection system is stored in the memory area, wherein the control unit is operatively connected to the pressure sensor for detecting the pressure profile, wherein the control unit includes a comparison unit configured to carry out a comparison of the detected pressure profile with the at least one reference pressure profile, wherein the control unit includes a unit for ascertaining at least one injection parameter as a function of the comparison.

13. The internal combustion engine as claimed in claim 11, wherein the injection system has a common high pressure accumulator and a plurality of injectors, wherein a fuel line leads from the common high pressure accumulator to each injector, wherein each fuel line has a restrictor between the high pressure accumulator and the injector assigned to the fuel line.

14. The internal combustion engine as claimed in claim 13, wherein the pressure sensor is arranged to detect a pressure in an individual accumulator of the injector, in the fuel line or in the common high pressure accumulator.

15. The internal combustion engine as claimed in claim 14, wherein the pressure sensor is arranged to detect the pressure in the fuel line, downstream of the restrictor.

16. The internal combustion engine as claimed in claim 13, further comprising an additional pressure sensor for detecting a pressure in the common high pressure accumulator, wherein the control unit is configured to determine an operating point of the injection system as a function of the pressure in the common high pressure accumulator.

17. The internal combustion engine as claimed in claim 11, wherein the control unit is configured to predefine an operating point of the injection system and to select a first reference pressure profile as a function of the operating point.

18. The internal combustion engine as claimed in claim 17, wherein the control unit is configured to actuate the at least one injector as a function of the operating point.

* * * * *